US008774440B2

(12) United States Patent
Karczmer

(10) Patent No.: US 8,774,440 B2
(45) Date of Patent: Jul. 8, 2014

(54) AIR CUSHIONED MICROPHONE CABLE RETRACTOR AND RECEPTACLE ASSEMBLY

(71) Applicant: Xedit Corporation, Queens Village, NY (US)

(72) Inventor: Claude M Karczmer, Jamaica Estates, NY (US)

(73) Assignee: Xedit Corporation, Queens Village, NY (US)

( * ) Notice: Subject to any disclaimer, the term of this patent is extended or adjusted under 35 U.S.C. 154(b) by 0 days.

(21) Appl. No.: 13/833,620

(22) Filed: Mar. 15, 2013

(65) Prior Publication Data

US 2013/0243233 A1 Sep. 19, 2013

Related U.S. Application Data

(60) Provisional application No. 61/611,115, filed on Mar. 15, 2012.

(51) Int. Cl.
*H04R 1/02* (2006.01)

(52) U.S. Cl.
USPC ..... 381/361; 381/355; 381/91; 381/87

(58) Field of Classification Search
CPC ..... H04R 1/02; H04R 1/021; H04R 1/025; H04R 11/04; H04R 2201/02; H04R 2201/025; H04R 1/08; H04R 19/04; H04R 9/08; H04R 11/06; H04R 1/38; H04R 2499/13; H04R 1/2892; B60R 11/0247; H04M 1/04; H04M 1/03
USPC ..... 381/82, 87, 91, 332, 334, 355, 361–368
See application file for complete search history.

(56) References Cited

U.S. PATENT DOCUMENTS

| | | | |
|---|---|---|---|
| 1,557,033 | A | 10/1925 | Davis |
| 1,642,132 | A | 9/1927 | Walter |
| 1,864,891 | A | 6/1932 | Coberly et al. |
| 2,969,436 | A | 1/1961 | Kilyk |
| 3,046,356 | A | 7/1962 | Jurgens et al. |
| 3,601,332 | A | 8/1971 | Kubelka |
| 5,526,997 | A | 6/1996 | Karczmer |

*Primary Examiner* — Brian Ensey
*Assistant Examiner* — Sabrina Diaz
(74) *Attorney, Agent, or Firm* — Diederiks & Whitelaw, PLC

(57) ABSTRACT

An air cushioned microphone cable retractor and receptacle assembly for use in controlling the deployment and retraction of a limited length of microphone cable includes a hollow cylindrical housing portion, in which a pulley mounted to a piston is disposed. A microphone cable is connected to the pulley, and then to the microphone, which is configured to reside in a top receptacle when not in use. In use, the microphone may be pulled out and away from the receptacle, at which time air above the piston is permitted to readily escape from above while the overall resistance is determined by operation of a lower relief valve. When the microphone is placed back in the receptacle, the weight of the piston pulls the cable back within the housing, with air venting structure providing an air damping feature to slow the retraction of the cable.

20 Claims, 2 Drawing Sheets

AIR CUSHIONED MICROPHONE CABLE RETRACTOR AND RECEPTACLE ASSEMBLY

CROSS-REFERENCE TO RELATED APPLICATIONS

The present application claims the benefit of U.S. Provisional Patent Application No. 61/611,115 filed Mar. 15, 2012.

BACKGROUND OF THE INVENTION

The present invention is directed to the art of audio communication and, more particularly, a microphone system wherein air resistance is employed to control the rate in which a microphone cable is both deployed from and retracted into a housing.

Microphone systems are often employed in order to effectively communicate an audio broadcast in various situations, such as when speeches are delivered to large groups. Although there is a trend toward wireless microphone systems, wireless communications are subjected to potential interference such that there is still a desire to employ wired microphone systems in a wide range of circumstances. However, wired microphone systems also have their associated drawbacks. For instance, during the use of a wired microphone, slack in the wire can become caught on adjacent structure or entangled upon itself.

To address this and other concerns, it has been proposed to wind a microphone cable within a housing such that the cable can be selectively deployed and retracted as needed. For instance, it is known to wind a microphone cable upon a reel within a housing and spring-load the reel. With this arrangement, the cable can be selectively deployed against the force of the spring and, when it is desired to retract the cable, the spring force aids in winding the cable back in the housing.

In some situations, it is only necessary to deploy a microphone cable for a rather limited degree. For example, if a speaker employs a microphone and does not walk around when talking, the microphone can be mounted to a holder or stand, while employing a fixed length of cable. In other situations, a relatively small amount of cable may be needed. In these cases, providing the cable within a housing is not necessary and having a system to wind the cable is simply not required. However, even when a relatively limited length of cable is to be deployed, benefits can be obtained by controlling cable deployment.

SUMMARY OF THE INVENTION

The present invention is directed to an air cushioned microphone cable retractor and receptacle assembly for use in controlling the deployment and retraction of a limited length of microphone cable. More specifically, in accordance with the invention, the housing of the assembly includes a hollow cylindrical portion, in which a pulley mounted to a piston is disposed. A microphone cable extends about the pulley, and is connected to the microphone, which is configured to reside or be seated in a top or other receptacle for the housing when not in use. In use, the microphone may be pulled out and away from the receptacle, at which time air above the piston is permitted to readily escape from above while the overall resistance is determined by operation of a lower relief valve. When the microphone is placed back in the receptacle, the weight of the piston pulls the cable back within the receptacle. Specifically placed air venting structure in the receptacle provides an air damping feature, in which the piston encounters sufficient air resistance to slow the retraction of the cable.

An optional cable lock mechanism can be employed to hold the cable in a microphone deployed condition. The invention is also directed to a method of deploying and extending a microphone employing the above-disclosed structure.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
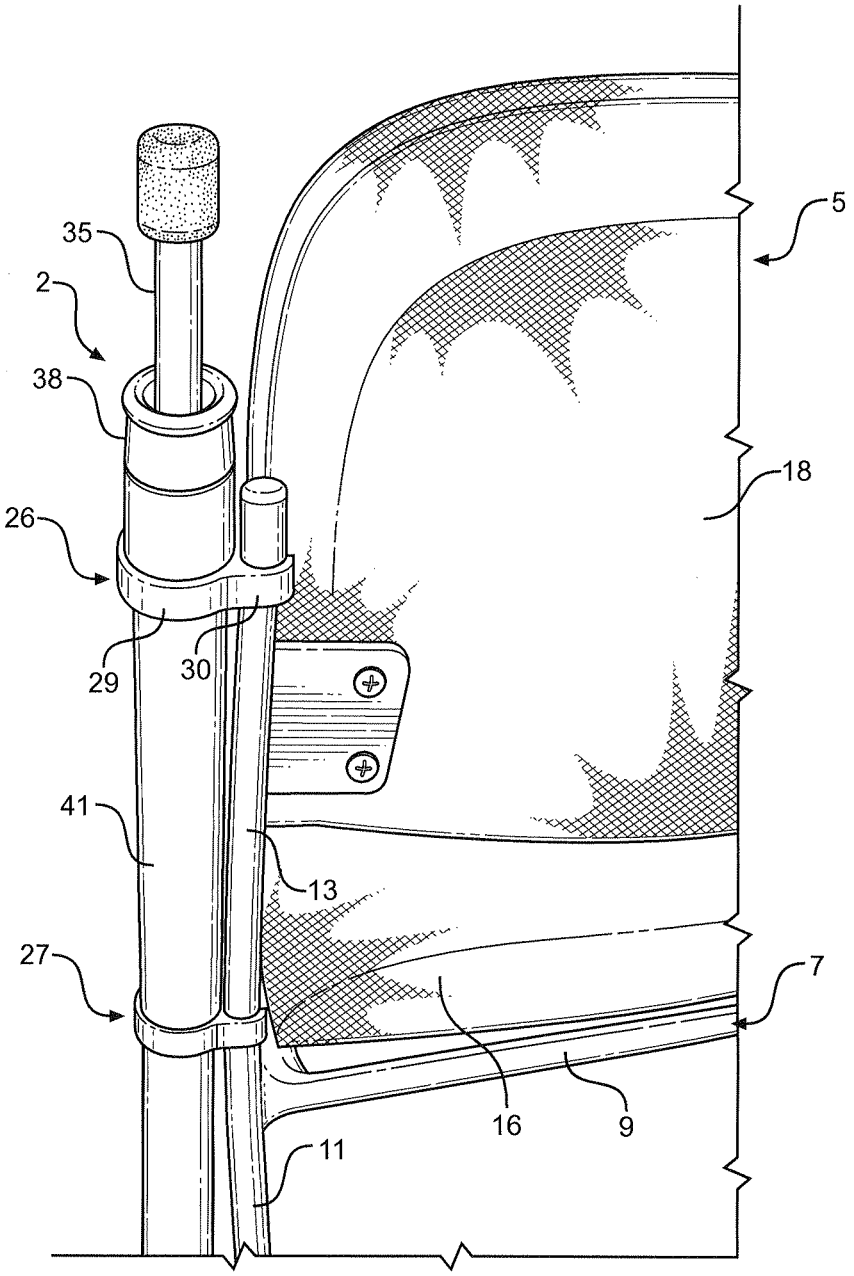
FIG. 1 is a perspective view of an air cushioned microphone cable retractor and receptacle assembly constructed in accordance with the present invention attached to a chair.

With initial reference to FIG. 1, an air cushioned microphone cable retractor and receptacle assembly constructed in accordance with the present invention is generally indicated at 2. As shown in this exemplary embodiment, assembly 2 is shown attached to a foldable chair 5 having a frame 7 including a seat frame portion 9, which is supported by a plurality of legs one of which is shown at 11, and spaced upstanding back support posts, one of which is shown at 13. Chair 5 also includes a seat cushion 16 mounted on seat frame portion 9 and a back panel 18 secured to posts 13.

As illustrated, assembly 2 is interconnected to frame 7. More specifically, assembly 2 includes clip supports 26 and 27, each of which includes a loop portion 29 and a clip member 30. This arrangement enables assembly 2 to be selectively mounted to chair 5. That is, assembly 2 includes a microphone 35 shown recessed in a top receptacle 38 of an elongated housing 41, with receptacle 38 conforming to the shape of microphone 35. With this arrangement, loop portions 29 of clip supports 26 and 27 tightly extend about housing 41 at spaced vertical locations, while each clip member 30 is snap-fit onto upstanding back support post 13, in order to fix assembly 2 onto chair 5.

Figure 2:
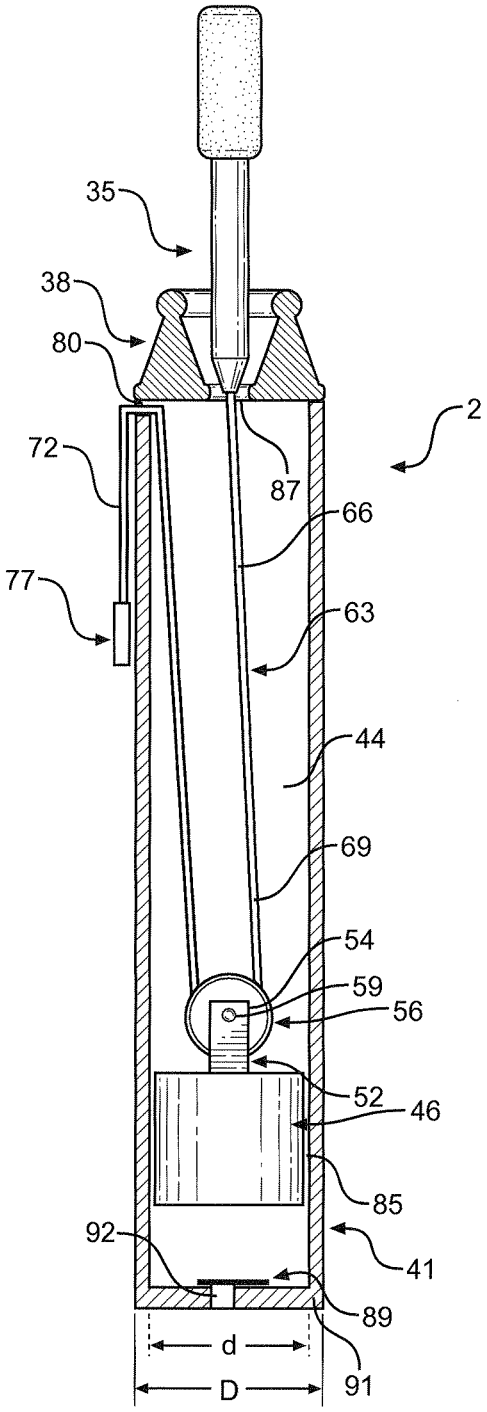
FIG. 2 is a schematic cross-sectional view of the air cushioned microphone cable retractor and receptacle assembly of the invention.

Reference will now be made to FIG. 2 to further detail the construction of assembly 2. As depicted, housing 41 preferably takes the form of a bottom closed cylinder or tube having an outer diameter D. With this arrangement, the housing 41 has at least top, bottom and side walls (not separately labeled). In addition, housing 41 includes an interior 44 having an interior diameter d, within which is shiftably mounted a piston 46. Piston 46 essentially defines a counterweight, such as established by a metal block, which is preferably coated with a low friction and/or noise suppression material, such as plastic. Provided atop piston 46 is a bracket 52 including a pair of spaced ears, one of which is shown at 54, between which a pulley 56 is rotatably mounted through a pin 59.

Assembly 2 also includes a microphone cable 63. More specifically, cable 63 includes a first end portion 66 which is electrically connected to microphone 35, an intermediate portion 69 which extends around pulley 56, and a second end portion 72 which extends outside of housing 41. Provided at a terminal section of second end portion 72 is an electrical output connector 77 which is adapted to be attached to a microphone extension line (not shown) used to interconnect microphone 35 to a speaker system (also not shown). As illustrated, second end portion 72 preferably includes a fixed section 80 which extends through and is secured to housing 41 such that a predetermined length for second end portion 72 is established, with this length preferably ranging from just shorter than the height of housing 41 to no length, i.e., connector 77 is actually mounted directly to housing 41.

When microphone 35 is in a retracted position as shown in FIG. 2, microphone 35 is lodged in receptacle 38, while tension is provided on cable 63 due to the weight of piston 46. That is, to assume this position, microphone 35 is pulled or drawn into the upper receptacle 38 by the counterweight piston 46 located inside of housing 41. During this retracting operation, partially trapped air within housing 41 operates to dampen the speed of retraction. More specifically, piston 46 has an outer diameter which is just slightly less than inner diameter d of housing 41 such that an annular gap 85 is established about piston 46. With this construction, the downward movement of piston 46 is dampened by the slow release of air from below piston 46 through annular gap 85.

When microphone 35 is pulled out for use, the air above piston 46 is free to escape through an opening 87 defined by receptacle 38. In addition, a relief valve 89 is optionally provided at a low portion of housing 41, such as in a bottom wall 91 of housing 41, to assure low resistance. When pulled to an extended position, microphone 35 is deployed for use, with piston 46 moving up within housing 41 and intermediate portion 69 of cable 63 being deployed out opening 87. When microphone 35 is released, the counterweight piston 46 drops slowly due to the air resistance below the weighted piston 46. Again, the rate of dissention is controlled through piston 46 and the flow of air through annular gap 85, as well as the size of an orifice 92 associated with relief valve 89. In particular, it should be noted that the rate of dissention can be altered by affecting the fit of piston 46 with respect to the internal diameter d of housing 41.

In general, the deployable length of cable 63 is somewhat less than twice the length or height of housing 41 when employing a single pulley as shown in FIG. 2. However, other configurations could be provided in accordance with the invention to establish some greater multiple of the length or height of housing 41. For instance, other pulley configurations could be employed, such as two lower pulleys used in combination with a single upper pulley, to result in a corresponding deployment distance with a shorter cable length or a longer cable length with a given housing (tube) length. Still, the overall length of cable 63 is quite short, such as in the order of 2-8 feet, and represents the terminal section of an overall operational cable based on the attachment made through connector 77.

Figure 3:
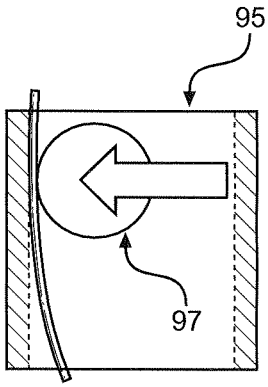
FIG. 3 is a schematic view of a cable lock employed with the air cushioned microphone cable retractor and receptacle assembly of the invention.

In addition to the above, assembly 2 can optionally include a cable lock unit such as that generally indicated at 95 in FIG. 3. Basically, cable lock unit 95 can take various forms, such as being added at the exit for cable 63 from housing 41 to hold cable 63 by friction against an upper stationary housing wall surface in a deployed state until released manually or by activating a microphone cradle linkage (not shown). Basically, cable lock unit 95 functions to frictionally pinch cable 63, such as through a supplemental, shiftable pulley or cam member 97, to retain cable 63 in a desired, deployed configuration. On the other hand, other cable lock arrangements could be employed.

Based on the above, it should be readily apparent that the overall assembly of the invention is completely passive, requiring no power for operation and basically no wearing parts. When attached to chair 5, the invention enables a speaker to readily use microphone 35 from a seated position, a standing position in front of chair 5, or even in a standing position offset from chair 5, such as in an adjacent aisle. In addition, the invention enables microphone 35 to be easily shared between individuals on a few adjacent chairs. Furthermore, with the inclusion of clips 26 and 27, assembly 2 can be readily supported upon and removed from chair 5.

Although described with reference to preferred embodiments of the invention, it should be readily understood that various changes and/or modifications can be made to the invention without departing from the spirit thereof. For instance, although the assembly is shown to be attached to a folding chair, the assembly could be readily configured to be mounted to a wide range of structures depending on the particular need. For example, the housing could be removably attached to a table, podium or the like. Also, it should be recognized that various air resistance arrangements could be employed in lieu of the particular embodiment described above, such as the inclusion of one or more through bores in the piston to accommodate a flow of air between opposing sides of the piston. Finally, although the invention has particular advantages in connection with the use of microphone cables, the invention could be employed in connection with other types of cables requiring limited deployment. In general, the invention is only intended to be limited by the scope of the following claims.

I claim:

1. A microphone cable retractor and receptacle assembly comprising:

a housing including an interior;

a piston mounted for movement within the interior of the housing;

a microphone arranged, at least partially, outside the housing;

a length of microphone cable including a first end portion attached to the microphone, an intermediate portion supporting the piston within the housing and a second end portion, wherein extension of the microphone away from the housing causes lifting of the piston within the housing and retraction of the microphone causes descending of the piston; and air venting structure providing resistance to movement of the piston within the housing upon extension and retraction of the microphone.

2. The microphone cable retractor and receptacle assembly according to claim 1, further comprising: a pulley mounted to the piston, the intermediate portion of the cable supporting the piston by extending about the pulley.

3. The microphone cable retractor and receptacle assembly according to claim 2, further comprising: a bracket mounted atop the piston, said bracket rotatably supporting the pulley.

4. The microphone cable retractor and receptacle assembly according to claim 1, wherein the air venting structure includes an annular gap about the piston, wherein downward movement of the piston within the housing is dampened by a slow release of air from below the piston through the annular gap.

5. The microphone cable retractor and receptacle assembly according to claim 1, further comprising: a receptacle provided on the housing, said microphone being seated in the receptacle when the microphone is retracted.

6. The microphone cable retractor and receptacle assembly according to claim 5, wherein the receptacle includes an opening through which the first end portion of the microphone cable extends and which forms part of the air venting structure which allows air above the piston to escape through the opening upon pulling the microphone away from the housing.

7. The microphone cable retractor and receptacle assembly according to claim 1, wherein the air venting structure includes a lower relief valve provided below the piston within the housing.

8. The microphone cable retractor and receptacle assembly according to claim 7, wherein the lower relief valve is provided in a bottom wall of the housing.

9. The microphone cable retractor and receptacle assembly according to claim 1, wherein the length of microphone cable is greater than a length or height of the housing.

10. The microphone cable retractor and receptacle assembly according to claim 1, further comprising: a cable lock unit to hold the length of microphone cable in a desired deployed condition.

11. The microphone cable retractor and receptacle assembly according to claim 10, wherein the cable lock unit retains the microphone cable by friction against an upper wall of the housing.

12. The microphone cable retractor and receptacle assembly according to claim 1, further comprising: a cable connector exposed outside the interior for connection to a microphone extension cable.

13. The microphone cable retractor and receptacle assembly according to claim 1, further comprising: at least one clip for interconnecting the housing to a chair.

14. The microphone cable retractor and receptacle assembly according to claim 13, wherein the housing constitutes a hollow cylindrical housing and the at least one clip includes a loop portion extending around the housing and a clip member for removable attachment to a chair.

15. A method of deploying and retracting a microphone relative to a housing including an interior, with the microphone being attached to a first end portion of a length of microphone cable while an intermediate portion of the microphone cable supports a piston mounted for movement within the interior of the housing, said method comprising:

deploying the microphone by withdrawing at least the first end portion of the microphone cable from the housing causing lifting of the piston within the housing, while providing air resistance to movement of the piston within the housing; and retracting the microphone, with the piston descending within the housing thereby drawing the first end portion of the microphone cable into the housing while resisting movement of the piston within the housing.

16. The method of claim 15, further comprising: lifting and lowering the piston within the housing with the microphone cable extending about a pulley mounted to the piston.

17. The method of claim 15, further comprising: providing the resistance to movement of the piston through air venting structure open both above and below the piston.

18. The method of claim 15, further comprising: selectively, frictionally retaining the microphone cable against the housing.

19. The method of claim 15, further comprising: attaching a microphone extension cable to a cable connector exposed outside the interior of the housing.

20. The method of claim 15, further comprising: deploying or retracting a length of microphone cable which is greater than a length or height of the housing.

* * * * *